US009010289B2

(12) United States Patent
Fujimura et al.

(10) Patent No.: US 9,010,289 B2
(45) Date of Patent: Apr. 21, 2015

(54) CONTROL DEVICE FOR HYDRAULIC VARIABLE VALVE TIMING MECHANISM

(75) Inventors: Haruhito Fujimura, Toyota (JP); Yuu Yokoyama, Okazaki (JP); Masaki Numakura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/257,484

(22) PCT Filed: Nov. 8, 2010

(86) PCT No.: PCT/JP2010/069858

§ 371 (c)(1),
(2), (4) Date: Sep. 19, 2011

(87) PCT Pub. No.: WO2012/063312

PCT Pub. Date: May 18, 2012

(65) Prior Publication Data

US 2013/0213326 A1 Aug. 22, 2013

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34453* (2013.01); *F01L 2001/34456* (2013.01); *F01L 2001/34476* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 5,738,056 | A | 4/1998 | Mikame et al. | |
| 6,311,654 | B1 | 11/2001 | Ushida et al. | |
| 6,505,586 | B1 | 1/2003 | Sato et al. | |
| 7,100,554 | B2 | 9/2006 | Hirowatari et al. | |
| 8,297,245 | B2 | 10/2012 | Urushihata | |
| 2005/0022763 | A1 | 2/2005 | Kobayashi et al. | |
| 2005/0098131 | A1 * | 5/2005 | Hirowatari et al. | 123/90.17 |
| 2005/0150473 | A1 | 7/2005 | Kobayashi et al. | |
| 2009/0020085 | A1 | 1/2009 | Hattori | |

(Continued)

FOREIGN PATENT DOCUMENTS

| | | |
|---|---|---|
| JP | A-2001-041012 | 2/2001 |
| JP | A-2001-050064 | 2/2001 |

(Continued)

OTHER PUBLICATIONS

International Search Report in International Application No. PCT/JP2010/069858; dated Dec. 7, 2010 (with English-language translation).

(Continued)

*Primary Examiner* — Thomas Denion
*Assistant Examiner* — Steven D Shipe
(74) *Attorney, Agent, or Firm* — Oliff PLC

(57) ABSTRACT

In a hydraulic variable valve timing mechanism including a lock pin that locks a vane rotor and a housing against relative rotation in the most retarding phase, a specified angle α is set so that release of the lock pin is started at a time when positive cam torque acts on the vane rotor. When the crank angle reaches the specified angle α, supply of hydraulic pressure to the advancing oil chamber is started to release the lock pin from the engagement with the lock hole, thereby enabling a reliable release of the lock pin prior to start of change of valve timing.

6 Claims, 7 Drawing Sheets

(56) References Cited

U.S. PATENT DOCUMENTS

| | | | | |
|---|---|---|---|---|
| 2010/0305835 | A1 | 12/2010 | Inoue et al. | |
| 2011/0030633 | A1 | 2/2011 | Urushihata | |
| 2013/0118428 | A1* | 5/2013 | Suzuki et al. | 123/90.15 |
| 2013/0146005 | A1* | 6/2013 | Watanabe | 123/90.15 |
| 2013/0213326 | A1 | 8/2013 | Fujimura et al. | |
| 2014/0069363 | A1 | 3/2014 | Yamaguchi et al. | |

FOREIGN PATENT DOCUMENTS

| | | | |
|---|---|---|---|
| JP | A-2003-020916 | | 1/2003 |
| JP | A-2003-172110 | | 6/2003 |
| JP | A-2005-036789 | | 2/2005 |
| JP | A-2005-076518 | | 3/2005 |
| JP | A-2005-207431 | | 8/2005 |
| JP | A-2007-153212 | | 6/2007 |
| JP | A-2007-255258 | | 10/2007 |
| JP | A-2009-024563 | | 2/2009 |
| JP | A-2009-024600 | | 2/2009 |
| JP | A-2009-024659 | | 2/2009 |
| JP | A-2010-209780 | | 9/2010 |
| JP | A-2010-223172 | | 10/2010 |
| JP | A-2010-275911 | | 12/2010 |
| JP | A-2011-038446 | | 2/2011 |
| JP | B-4883244 | | 2/2012 |
| KR | 10-1997-0070418 | A | 11/1997 |
| KR | 10-2001-0030066 | A | 4/2001 |
| KR | 10-2004-0050307 | A | 6/2004 |
| WO | WO 2012/063312 | A1 | 5/2012 |

OTHER PUBLICATIONS

Apr. 15, 2014 Office Action issued in U.S. Appl. No. 13/519,370.
Sep. 2, 2014 Office Action issued in U.S. Appl. No. 13/519,370.

* cited by examiner

CONTROL DEVICE FOR HYDRAULIC VARIABLE VALVE TIMING MECHANISM

FIELD OF THE INVENTION

The present invention relates to a device for controlling a hydraulic variable valve timing mechanism that is hydraulically operated to vary the valve timing of engine valves.

BACKGROUND OF THE INVENTION

As a mechanism installed in an internal combustion engine of a vehicle, a variable valve timing mechanism that allows valve timing of engine valves (intake and exhaust valves) to be varied, as described in Patent Documents 1 and 2, has been known. As a variable valve timing mechanism that has been put into practical use, there is a hydraulic mechanism that operates based on hydraulic pressure, as described in Patent Document 1.

As shown in FIG. 6, in the hydraulic variable valve timing mechanism 1, a vane rotor 3 is fixed to a camshaft 2 to rotate integrally with the camshaft 2. A substantially annular housing 5 is disposed about the outer circumference of the vane rotor 3 to be rotatable relative to the vane rotor 3. The housing 5 is fixed to a cam sprocket 4 to integrally rotate with the cam sprocket 4. On the outer circumference of the vane rotor 3, a plurality of vanes 6 are formed so as to project along the radial direction. Each vane 6 is housed in each of recessed portions 7, the number of which is equal to that of the vanes 6, formed on the inner circumference of the housing 5.

Inside each recessed portion 7, two oil chambers are defined by a vane 6. Of these, the oil chamber formed in the camshaft rotation direction of the vane 6 is a retarding oil chamber 8 in which hydraulic pressure is introduced to retard valve timing. The oil chamber formed in the camshaft counter-rotation direction of the vane 6 is an advancing oil chamber 9 in which hydraulic pressure is introduced to advance valve timing. The hydraulic pressure in the retarding oil chamber 8 and the hydraulic pressure in the advancing oil chamber 9 are adjusted by an oil control valve (OCV) 11 controlled by an electronic control unit (ECU) 10 for engine control.

Such a hydraulic variable valve timing mechanism includes a mechanical lock mechanism that maintains valve timing when the engine is started with insufficient hydraulic pressure. The lock mechanism is formed by a lock pin 12 slidably disposed with one of the vanes 6 of the vane rotor 3 and a lock hole 13 formed in the cam sprocket 4. The lock pin 12 can be fitted in the lock hole 13. The lock pin 12 is biased in the direction to be fitted in the lock hole 13 by a spring 14 provided at the proximal end of the lock pin 12. To the lock pin 12, hydraulic pressure is applied so as to resist the biasing force of the spring 14 in response to supply of hydraulic pressure to the retarding oil chamber 8 or the advancing oil chamber 9. As such a mechanical lock mechanism, there is also known a configuration in which a lock pin and a lock hole are provided on the radially inner circumference of the housing and on the radially outer circumference of the vane.

In the hydraulic variable valve timing mechanism 1 shown in the same drawing, the lock pin 12 and the lock hole 13 are disposed so that they are aligned when the vane rotor 3 rotates relative to the housing 5 to the maximum setting in the retarding direction (in the counter-rotation direction of the camshaft 2). There is also known a hydraulic variable valve timing mechanism that executes locking at the most advancing phase, at which a vane rotor 3 rotates to the maximum setting in the rotation direction of the camshaft 2 relative to the housing 5, and a hydraulic variable valve mechanism that executes locking in an intermediate locking phase between the most advancing phase and the most retarding phase.

In the hydraulic variable valve timing mechanism having such a lock mechanism, hydraulic pressure is supplied to the retarding oil chamber 8 and the advancing oil chamber 9 after the engine is started. After the lock pin 12 is released (disengaged from the lock hole 13), relative rotation of the vane rotor 3 with respect to the housing 5, that is, change of a valve timing, is started.

PRIOR ART DOCUMENTS

Patent Documents

Patent Document 1: Japanese Laid-Open Patent Publication No. 2001-41012

Patent Document 2: Japanese Laid-Open Patent Publication No. 2005-76518

SUMMARY OF THE INVENTION

In the hydraulic variable valve timing mechanism 1, in which locking is executed in the most retarding position as shown in FIG. 6, the lock pin 12 is released after the engine is started, and change of a valve timing in the advancing direction will be started. At this time, however, as shown in FIG. 7, (*a*) when release of the lock pin 12 is started by supply of hydraulic pressure to the advancing oil chamber 9, (*b*) if the vane rotor 3 starts rotating toward the advancing side before the lock pin 12 is released, (*c*) the lock pin 12 may get caught by the advancing side circumferential perimeter of the lock hole 13 (the part circled as B in FIG. 7(*c*)). This causes a failure in release of the lock pin 12. Such a problem may also occur in a configuration where locking is executed in a position other than the most retarding position, in a configuration where the lock pin and the lock hole are located along the radial direction of the housing and the vane, or in other configurations.

In view of the above circumstances, an objective of the present invention is to provide a hydraulic variable valve timing mechanism that enables a more reliable release of the lock pin prior to commencement of change of valve timing.

A first invention according to the present application is configured to control a hydraulic variable valve timing mechanism that has the following components (A) to (E) and allows valve timing of engine valves to be varied through relative rotation of the first and second rotators as described below:

(A) a first rotator fixed to a camshaft so as to rotate integrally with the camshaft;

(B) a second rotator that is rotatable relative to the first rotator;

(C) a retarding oil chamber in which hydraulic pressure is introduced to rotate the first rotator relative to the second rotator in such a direction as to retard valve timing;

(D) an advancing oil chamber in which hydraulic pressure is introduced to rotate the first rotator relative to the second rotator in such a direction as to advance valve timing; and (E) a lock pin that mechanically locks the first and second rotators against relative rotation when engaged with the lock hole and allows relative rotation of the first and second rotators when released from the engagement with the lock hole in response to supply of hydraulic pressure.

To solve the above problem, a control device for the hydraulic variable valve timing mechanism according to the first invention of the present application starts supply of hydraulic pressure to release the lock pin from the engagement with the lock hole when the crank angle is a specified angle.

Cam torque acts on the first rotator, which is fixed to the camshaft so as to rotate integrally with the camshaft. The magnitude and direction of such cam torque changes according to the crank angle. Depending on the magnitude and direction of the cam torque, release of the lock pin from the engagement with the lock hole in response to supply of hydraulic pressure becomes easy or difficult.

In that respect, in the first invention, since supply of hydraulic pressure to release the lock pin from the engagement with the lock hole is started when the crank angle becomes a specified angle, a timing of the release can be adjusted so that the lock pin can be released when the cam torque reaches a magnitude that allows the lock pin to be easily released. Therefore, according to the first invention, the release of the lock pin prior to the start of change of valve timing can be performed more reliably.

A specified angle here does not refer to only a predetermined specific angle. It may be a variable value that is determined based on the operating state or the like of the internal combustion engine.

A second invention according to the present application is configured to control a hydraulic variable valve timing mechanism that has the above-described components (A) to (E) and allows valve timing of engine valves to be varied through relative rotation of the first and second rotators.

To solve the above problem, a control device for the hydraulic variable valve timing mechanism according to the second invention of the present application starts supply of hydraulic pressure to release the lock pin from the engagement with the lock hole based on the crank angle.

Cam torque acts on the first rotator, which is fixed to the camshaft so as to rotate integrally with the camshaft. The magnitude and direction of such cam torque changes according to the crank angle. Depending on the magnitude and direction of the cam torque, release of the lock pin from the engagement with the lock hole in response to supply of hydraulic pressure becomes easy or difficult.

In that respect, in the second invention, since supply of hydraulic pressure to release the lock pin from the engagement with the lock hole is started based on the crank angle, the timing of the release can be adjusted so that the lock pin is released when the cam torque reaches a magnitude that allows the lock pin to be easily released. Therefore, according to the second invention, the release of the lock pin prior to the start of change of valve timing can be performed more reliably.

The lock pin may be configured so that it can be released from the engagement with the lock hole in response to supply of hydraulic pressure to either the retarding oil chamber or the advancing oil chamber. In this case, if the above either one oil chamber to which hydraulic pressure to release the lock pin from the engagement with the lock hole is supplied is set as an oil chamber to which hydraulic pressure to change the valve timing is first supplied after the engine is started, a series of operations from the release of the lock pin to the start of change of the valve timing can be conducted promptly.

In this case, setting the start timing of supply of hydraulic pressure so that the unlocking is started when cam torque acts on the first rotator in the direction opposite to the direction of relative rotation caused by supply of hydraulic pressure to the above either one oil chamber enables a reliable unlocking.

A third invention according to the present application is configured to control a hydraulic variable valve timing mechanism that has the following components (F) to (J) and allows valve timing of engine valves to be varied through relative rotation of the first and second rotators as described below:

(F) a first rotator fixed to a camshaft so as to rotate integrally with the camshaft;

(G) a second rotator that is rotatable relative to the first rotator;

(H) a retarding oil chamber in which hydraulic pressure is introduced to rotating the first rotator relative to the second rotator in such a direction as to retard valve timing;

(I) an advancing oil chamber in which hydraulic pressure is introduced to rotating the first rotator relative to the second rotator in such a direction as to advance valve timing; and (J) a lock pin that mechanically locks the first and second rotators against relative rotation when engaged with the lock hole and allows relative rotation of the first and second rotators when released from the engagement with the lock hole in response to supply of hydraulic pressure to either the retarding oil chamber or the advancing oil chamber.

To solve the above problem, the third invention starts supply of hydraulic pressure to the above either one oil chamber to release the lock pin from the engagement with the lock hole so that the release from the engagement with the lock hole in response to supply of hydraulic pressure to the above one oil chamber is started at the time when cam torque acts on the first rotator in the direction opposite to the direction of relative rotation caused by supply of hydraulic pressure to the above either one oil chamber.

In the third invention, since the lock pin is released from the engagement with the lock hole in response to supply of hydraulic pressure to either the retarding oil chamber or the advancing oil chamber, the first and second rotators tend to start relative rotation simultaneously with the release of the lock pin. If relative rotation of the first and second rotators starts before the lock pin is released, the lock pin is pressed against the side circumference of the lock hole, resulting in difficulty in release from the engagement.

In that respect, in the above third invention, the release of the lock pin from the engagement with the lock hole is started at the time when cam torque acts on the first rotator in the direction opposite to the direction of relative rotation caused by the release of the lock pin. Thus, the lock pin is released while the cam torque is restraining relative rotation of the first and second rotators. Therefore, according to the above third invention, the lock pin can be more reliably released prior to start of change of valve timing.

In such a case, when the above either one oil chamber to which hydraulic pressure is supplied so that the lock pin is released from the engagement with the lock hole is set as an oil chamber to which hydraulic pressure for changing the valve timing is first supplied after the engine is started, a series of operations from the release of the lock pin to the start of change of the valve timing can be conducted promptly.

DETAILED DESCRIPTION OF THE PREFERRED EMBODIMENTS

Figure 1:
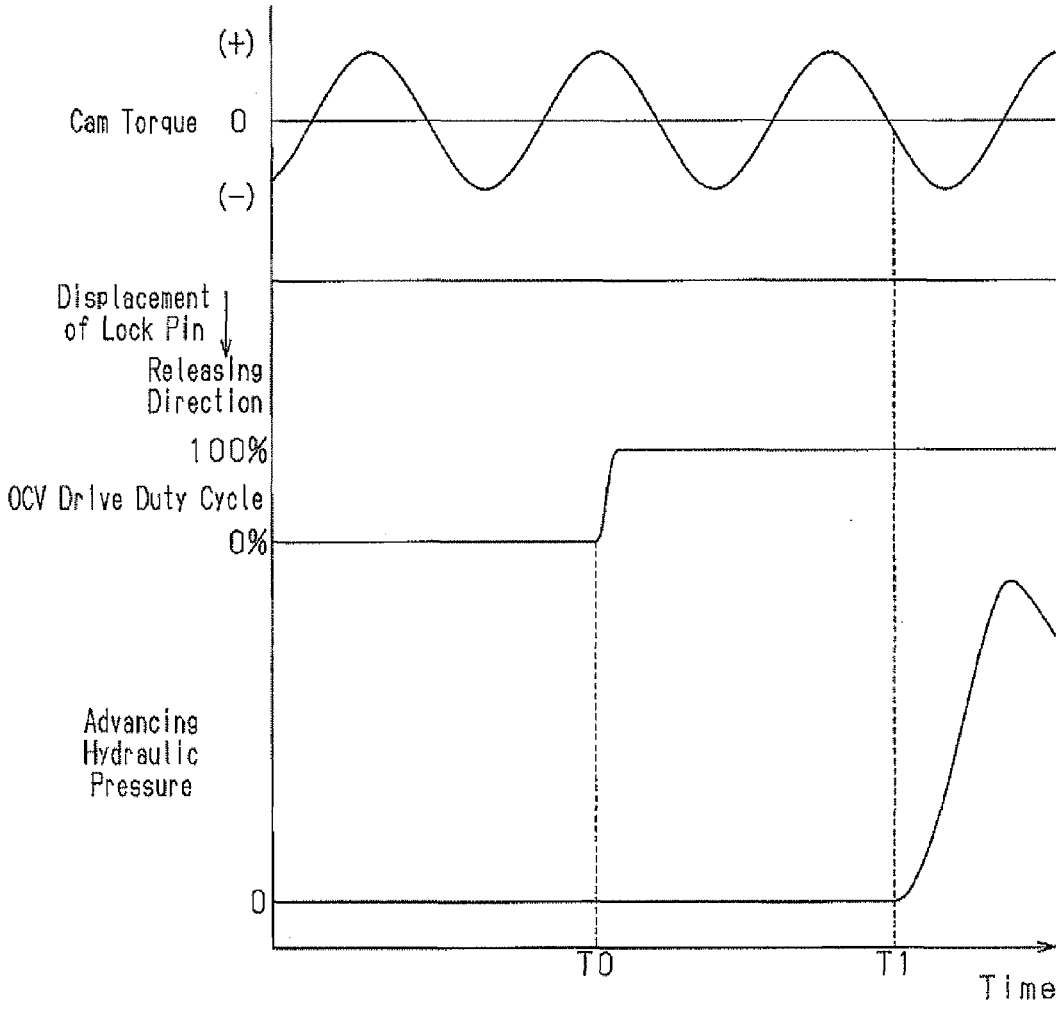
FIG. 1 is a graph showing changes in cam torque, OCV drive duty cycle, advancing hydraulic pressure, and displacement of a lock pin when a failure in release occurs.

Hereinafter, a control device for a hydraulic variable valve timing mechanism according to one embodiment of the present invention will be described with reference to FIGS. 1 to 5. The hydraulic variable valve timing mechanism to be controlled by the control device of this embodiment allows the valve timing of intake valves to be varied and has a configuration that is basically the same as that shown in FIG. 6. Specifically, the hydraulic variable valve timing mechanism 1 to be controlled in this embodiment has the following components (A) to (E):

(A) a vane rotor 3 as a first rotator that is fixed to a camshaft 2 so as to rotate integrally with the camshaft 2;

(B) a housing 5 as a second rotator that is rotatable relative to the vane rotor 3;

(C) a retarding oil chamber 8 in which hydraulic pressure is introduced to rotate the vane rotor 3 relative to the housing 5 in such a direction that retards the valve timing;

(D) an advancing oil chamber 9 in which hydraulic pressure is introduced to rotate the vane rotor 3 relative to the housing 5 in such a direction that advances the valve timing; and (E) a lock pin 12 that mechanically locks the vane rotor 3 and the housing 5 against relative rotation when engaged with the lock hole 13 and allows relative rotation of the vane rotor 3 and the housing 5 when released from engagement with the lock hole 13 in response to supply of hydraulic pressure.

In this hydraulic variable valve timing mechanism, the lock pin 12 and the lock hole 13 are disposed so as to be aligned when the vane rotor 3 rotates to the maximum setting in the camshaft counter-rotation direction relative to the housing 5 and is located in the most retarded phase.

In addition, this hydraulic variable valve timing mechanism is configured so that hydraulic pressure for releasing, that is, hydraulic pressure which acts on such a direction that the lock pin 12 is disengaged from the lock hole 13 against a biasing force of the spring 14 in response to supply of hydraulic pressure to the retarding oil chamber 8 and the advancing oil chamber 9, is applied to the lock pin 12. Specifically, one of the retarding oil chambers 8 communicates with the lock pin releasing oil chamber 16 (see FIG. 2 and FIG. 4) formed in the lock hole 13 and a part of the oil passage to the advancing oil chamber 9 communicates with the lock pin releasing oil chamber 15 (see FIG. 6) of the lock pin 12, thereby realizing the above-described application of hydraulic pressure.

An ECU 10 as a control section controls operation of the hydraulic variable valve timing mechanism 1 through adjustment of hydraulic pressure of the retarding oil chamber 8 and the advancing oil chamber 9 by the duty cycle control of an OCV 11. Specifically, the ECU 10 drives the OCV 11 to supply hydraulic pressure to the retarding oil chamber 8 and release hydraulic pressure from the advancing oil chamber 9, thereby rotating the vane rotor 3 relative to the housing 5 in the counter-rotation direction of the camshaft 2 to retard the valve timing. The ECU 10 also drives the OCV 11 to release hydraulic pressure from the retarding oil chamber 8 and supply hydraulic pressure to the advancing oil chamber 9, thereby rotating the vane rotor 3 relative to the housing 5 in the rotation direction of the camshaft 2 to advance the valve timing. Furthermore, the ECU 10 supplies holding hydraulic pressure to each of the retarding oil chamber 8 and the advancing oil chamber 9 to balance the hydraulic pressure in both sides of the vane 6, thereby maintaining the valve timing.

The ECU 10 rotates the vane rotor 3 to the most retarding phase, engages the lock pin 12 with the lock hole 13 and then stops the engine. Therefore, in this hydraulic variable valve timing mechanism 1, the engine is started with the lock pin 12 being engaged with the lock hole 13.

In the present embodiment, the ECU 10 starts a variable valve timing control after the engine is started according to the procedure described below. First, the ECU 10 supplies hydraulic pressure to the retarding oil chamber 8. At this time, supply of hydraulic pressure to the retarding oil chamber 8 is not intended for a reliable release of the lock pin 12. Next, the ECU 10 supplies hydraulic pressure to the advancing oil chamber 9 so as to release the lock pin 12 from the engagement with the lock hole 13. Then, the ECU 10 keeps supplying hydraulic pressure to the advancing oil chamber 9 even after the lock pin 12 is released, thereby advancing the valve timing.

In such a case, depending on the start timing of supply of hydraulic pressure to the advancing oil chamber 9 to release the lock pin 12, a failure in release of the lock pin 12 may occur. FIG. 1 shows changes in cam torque, displacement of the lock pin, OCV drive duty cycle, and advancing hydraulic pressure when a failure in release of the lock pin occurs. The cam torque shown here is cam torque when the counter-rotation direction of the camshaft 2 is positive.

The ECU 10 changes the drive duty cycle of the OCV 11 from 0% to 100% at time T0 to start supply of hydraulic pressure to the advancing oil chamber 9. However, due to the delay in response of the hydraulic pressure system, the hydraulic pressure of the advancing oil chamber 9 starts increasing at the later time T1. The cam torque at this time is negative, and the vane rotor 3 at this time is biased to the rotation direction (advancing direction) of the camshaft 2 by the cam torque.

After the rise in hydraulic pressure of the advancing oil chamber 9 at this time, the vane rotor 3 rotates by the pin clearance, thereby causing a change in the hydraulic pressure.

Figure 2A:
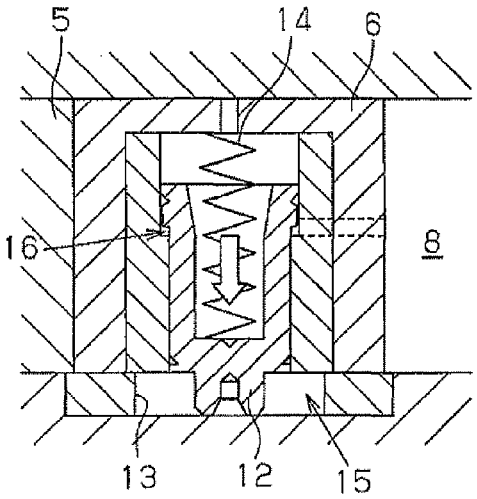
FIGS. 2(*a*) to 2(*c*) are diagrams showing changes in the state of a lock pin when a failure in release occurs.
Figure 2B:
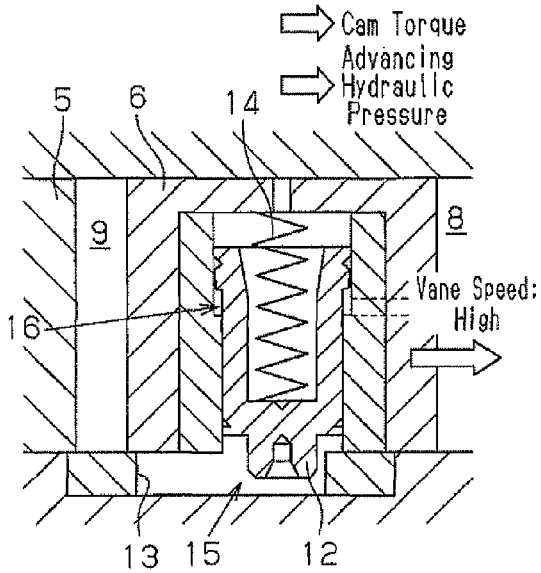
Figure 2C:
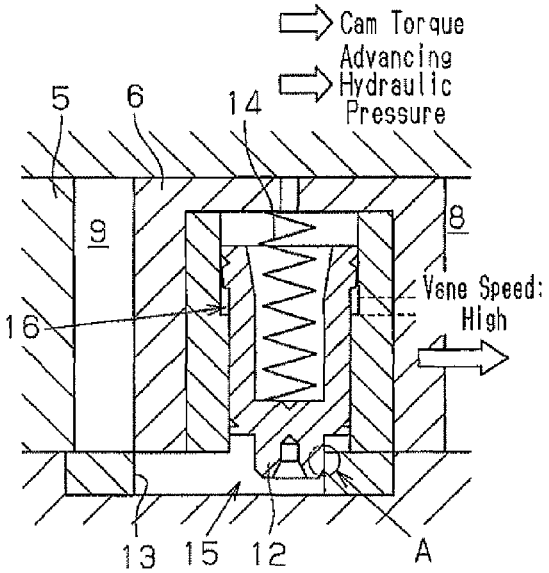

FIG. 2(*a*) shows the state of the lock pin 12 when the engine is started. As shown in this figure, the lock pin 12 at this time is in the state of being engaged with the lock hole 13 by the biasing force of the spring 14.

After that, when the hydraulic pressure of the advancing oil chamber 9 starts rising, release hydraulic pressure against the biasing force of the spring 14 starts being applied to the lock pin 12, while the vane 6 starts rotating in the advancing direction as shown in FIG. 2(*b*). At this time, if a negative cam torque acts, the vane rotor 3 will be biased in the advancing direction by the cam torque as well as by the hydraulic pressure of the advancing oil chamber 9. As a result, the rotation speed of the vane rotor 3 to the advancing side at this time will become relatively high.

As shown in FIG. 2(*c*), if the vane rotor 3 rotates to the position in which the lock pin 12 contacts the side circumference on the advancing side of the lock hole 13 before the lock pin 12 is completely released, the lock pin 12 gets caught in the side circumference of the lock hole 13 (the part circled as A in FIG. 2(*c*)). As a result, in this case, a failure in release of the lock pin 12 may occur.

As described above, the performance of releasing the lock pin 12 is significantly related to the magnitude and direction of the cam torque at the time of commencement of the release of the lock pin 12. Based on that finding, in this embodiment, the start timing for supply of hydraulic pressure to the advancing oil chamber 9 is set based on the crank angle so that the release of the pin 12 is started at the time when the cam torque reaches a state where the lock pin 12 is easily released.

The crank angle is detected by a crank angle sensor. An output of the crank angle sensor has a correlation to an output of a cam angle sensor.

Figure 3:
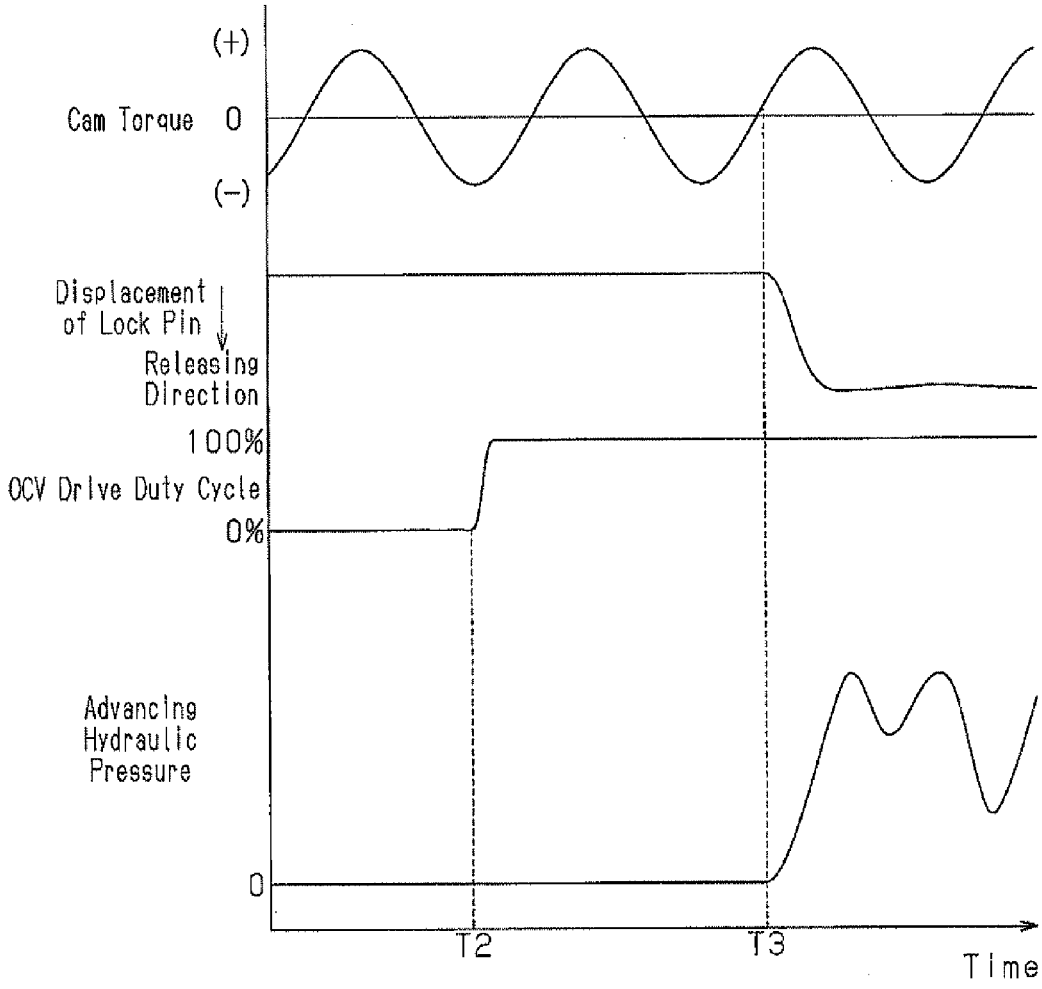
FIG. 3 is a graph showing changes in cam torque, OCV drive duty cycle, advancing hydraulic pressure, and displacement of a lock pin in one embodiment of the present invention.

FIG. 3 shows changes in cam torque, displacement of the lock pin, OCV drive duty cycle, and advancing hydraulic pressure in the present embodiment. The ECU 10 changes the drive duty cycle of the OCV 11 from 0% to 100% at time T2 in the same graph to start supply of hydraulic pressure to the advancing oil chamber 9. Then, at time T3 after a lapse of a certain response delay period, the hydraulic pressure of the advancing oil chamber 9 starts increasing. The cam torque at this time is positive, and the vane rotor 3 at this time is biased to the counter-rotation direction (retarding direction) of the camshaft 2 by the cam torque.

After the rise in hydraulic pressure of the advancing oil chamber 9 at this time, the lock pin 12 is released and the vane rotor 3 rotates to the advancing side, thereby causing a change in the hydraulic pressure.

Figure 4A:
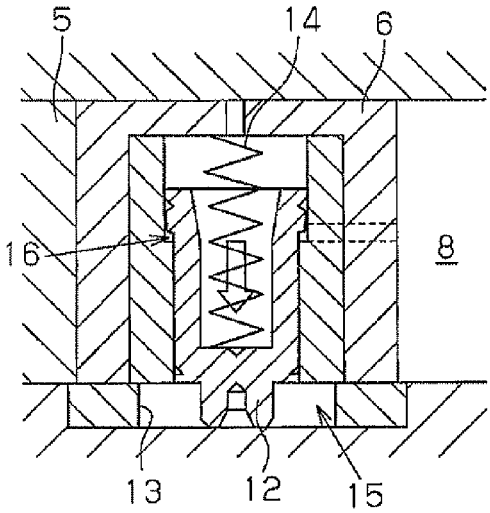
FIGS. 4(*a*) to 4(*c*) are diagrams showing operation of a lock pin when it is released in the same embodiment.
Figure 4B:
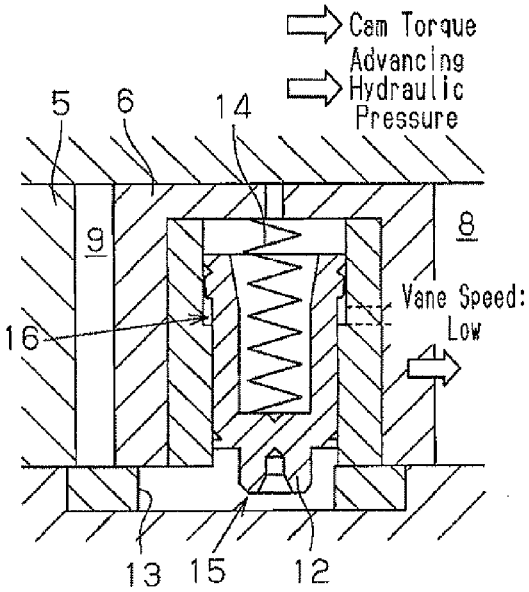
Figure 4C:
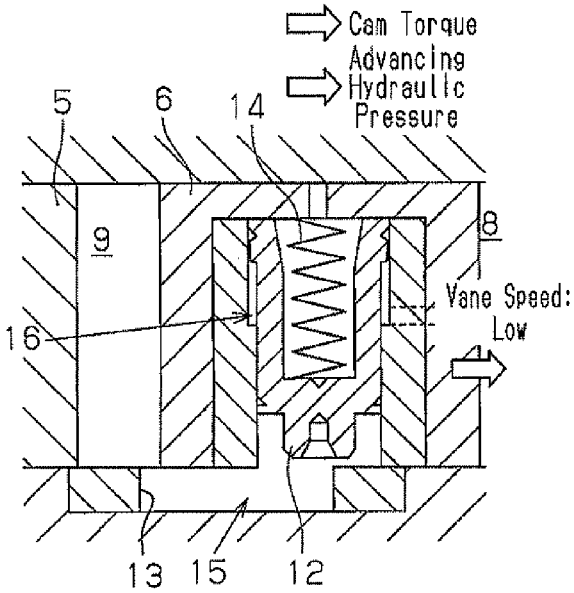

FIG. 4(*a*) shows the state of the lock pin 12 when the engine is started in this embodiment. As shown in this figure, in this embodiment, the lock pin 12 at this time is also in a state of being engaged with the lock hole 13 by the biasing force of the spring 14.

After that, when the hydraulic pressure of the advancing oil chamber 9 starts rising, the releasing hydraulic pressure against the biasing force of the spring 14 starts being applied to the lock pin 12, while the vane 6 starts rotating in the advancing direction as shown in FIG. 4(*b*). In this embodiment, a positive cam torque acts on the vane rotor 3 so that it resists being rotated in the advancing direction by the hydraulic pressure of the advancing oil chamber 9. As a result, the rotation speed of the vane rotor 3 at this time becomes lower than the case shown in FIG. 2(*b*).

If the rotation speed of the vane rotor 3 in the advancing direction is low, sufficient time is ensured before the vane rotor 3 rotates to the position where the lock pin 12 contacts the advancing side circumference of the lock hole 13. As a result, the lock pin 12 at this time is released smoothly without getting caught in the side circumference of the lock hole 13, as shown in FIG. 4(*c*).

If the valve timing is fixed by the lock pin 12, the time when the cam torque becomes positive is uniquely defined by the crank angle. In addition, since the engine speed when the lock pin 12 is released is generally constant, the variation of the crank angle during the response delay period of the hydraulic pressure system, which is from the command to start supplying hydraulic pressure to the advancing oil chamber 9 till the actual rise in hydraulic pressure of the advancing oil chamber 9, can be determined as one value in advance or calculated based on various quantities of state. Therefore, if the start timing of supply of hydraulic pressure to the advancing oil chamber 9 is set based on the crank angle, the start timing of supply of hydraulic pressure can be adjusted so that release of the lock pin 12 is started when the cam torque becomes positive. That is, in this embodiment, the start timing of supply of hydraulic pressure to the advancing oil chamber 9 to release the lock pin 12 is set so that release of the lock pin 12 from the engagement with the lock hole 13 is started at the time when cam torque acts on the vane rotor 3 in the direction opposite to the direction of relative rotation caused by supply of hydraulic pressure to the advancing oil chamber 9.

Figure 5:
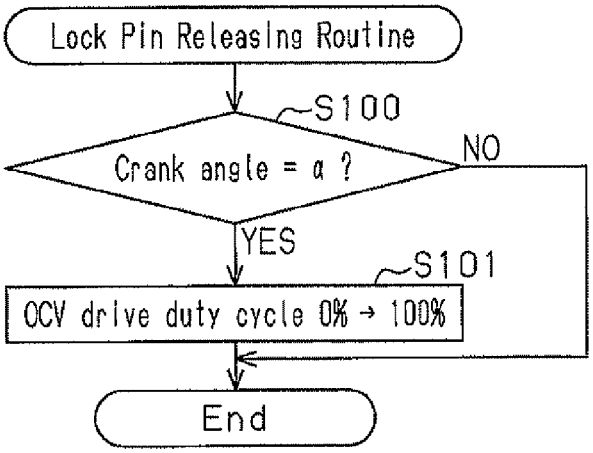
FIG. 5 is a flowchart for the lock pin releasing routine adopted in the same embodiment.

FIG. 5 shows a flowchart for the lock pin releasing routine adopted in the present embodiment. The processing of this routine is repeatedly executed by the ECU 10 in a predetermined control frequency, during the period from the fulfillment of the condition for starting a variable valve timing control till the start of the same variable valve timing control after the engine is started.

After this routine is started, the ECU 10 first judges whether the crank angle is a specified angle α at Step S100. If the crank angle is not the specified angle α (S100: NO), the ECU 10 ends the processing of this routine as it is.

If the crank angle is the specified angle α (S100: YES), the ECU 10 sets the OCV drive duty cycle at 100% at Step S101 and starts supply of hydraulic pressure to the advancing oil chamber 9. The specified angle α is set so that the start timing of release of the lock pin 12 in response to supply of hydraulic pressure occurs at the time when cam torque acts on the vane rotor 3 in the direction opposite to the direction of relative rotation caused by supply of hydraulic pressure to the advancing oil chamber 9.

The present embodiment is configured so that the advancing oil chamber 9 corresponds to the above either one oil chamber to which hydraulic pressure for changing the valve timing is supplied first after the engine is started.

In the case where the start timing of supply of hydraulic pressure for releasing the lock pin 12 is set as described above, the lock pin 12 can be released only by supply of hydraulic pressure to the advancing oil chamber 9, without the need for releasing the lock pin 12 in advance by supply of hydraulic pressure to the retarding oil chamber 8 prior to supply of hydraulic pressure to the advancing oil chamber 9. Therefore, even if it is configured in such a manner that the retarding oil chamber 8 communicates with the lock pin releasing oil chamber 15 and the lock pin releasing hydraulic pressure does not act in response to supply of hydraulic pressure to the retarding oil chamber 8, a smooth operation of the hydraulic variable valve timing mechanism 1 is possible. When the connection between the retarding oil chamber 8 and the lock hole 13 is eliminated, the following advantages are obtained.

Specifically, if the lock pin 12 is released before the hydraulic pressure in the retarding oil chamber 8 sufficiently rises, the rotation of the vane rotor 3 cannot be maintained and the vane 6 may swing and collide with the housing 5 against the side wall of the recessed portion 7. This can be avoided by elimination of the connection between the retarding oil chamber 8 and the lock pin releasing oil chamber 15.

In addition, when an attempt is made to engage the lock pin 12 with the lock hole 13 while the vane rotor 3 is being rotated to the most retarding phase at the time of engine stop, the lock pin 12 does not get engaged till the hydraulic pressure of the retarding oil chamber 8 becomes sufficiently lowered. Therefore, the engagement takes considerable time. Such a problem can be avoided by elimination of the connection between the retarding oil chamber 8 and the lock pin releasing oil chamber 15.

According to the embodiment described above, the following advantages are obtained.

(1) In this embodiment, the ECU 10 sets the start timing of supply of hydraulic pressure for releasing the lock pin 12 from the engagement with the lock hole 13 based on the crank angle. More specifically, the start timing of supply of hydraulic pressure to the advancing oil chamber 9 for releasing the lock pin 12 is set such that release of the lock pin 12 from the engagement with the lock hole 13 is started when cam torque acts on the vane rotor 3 in the direction opposite to the direction of relative rotation caused by supply of hydraulic pressure to the advancing oil chamber 9. As a result, the timing can be adjusted such that the lock pin 12 can be released when the cam torque reaches a magnitude that allows the lock pin 12 to be easily released, that is, when the cam torque is positive. Therefore, according to this embodiment, the lock pin 12 can be reliably released prior to commencement of change of the valve timing.

(2) In this embodiment, the lock pin 12 is released in response to supply of hydraulic pressure to the advancing oil chamber 9 to which the hydraulic pressure for changing the valve timing is first supplied after the engine starts. Therefore, a series of operations from the release of the lock pin 12 to the start of change of the valve timing can be conducted promptly.

(3) In this embodiment, it is possible to release the lock pin 12 simply by supply of hydraulic pressure to the advancing oil chamber 9, the connection between the retarding oil chamber 8 and the lock pin releasing oil chamber 15 can be eliminated, and furthermore, the lock pin releasing oil chamber 15 can be eliminated.

This embodiment described above may be modified as follows.

In some hydraulic variable valve timing mechanisms in which the valve timing of the exhaust valves is made variable, locking by the lock pin 12 is performed in the most advancing phase. The control device of the present invention is applicable also to such a hydraulic variable valve timing mechanism in which locking is performed in the most advancing phase. In this case, after the engine is started, the oil chamber to which hydraulic pressure for changing the valve timing is first supplied is the retarding oil chamber. In this case, the lock pin is released in response to supply of hydraulic pressure to the retarding oil chamber and the start timing of supply of hydraulic pressure to the retarding oil chamber to release the lock pin is set such that the release of the lock pin is started at the time when the cam torque becomes negative. As a result, the lock pin can be reliably released prior to start of change of valve timing.

In some hydraulic variable valve timing mechanisms, locking by the lock pin is performed at an intermediate locking phase between the most advancing phase and the most retarding phase. The control device of the present invention is applicable also to such a mechanism. In the case where the lock pin is released by supply of hydraulic pressure to the advancing oil chamber, the lock pin can be more reliably released prior to start of change of valve timing by setting the start timing of supply of hydraulic pressure to the advancing oil chamber so that release of the lock pin is started at the time when the cam torque becomes positive. In the case where the lock pin is released by supply of hydraulic pressure to the retarding oil chamber, the lock pin can be reliably released prior to start of change of valve timing by setting the start timing of hydraulic pressure supply to the retarding oil chamber so that release of the lock pin is started at the time when the cam torque becomes negative.

Figure 6:
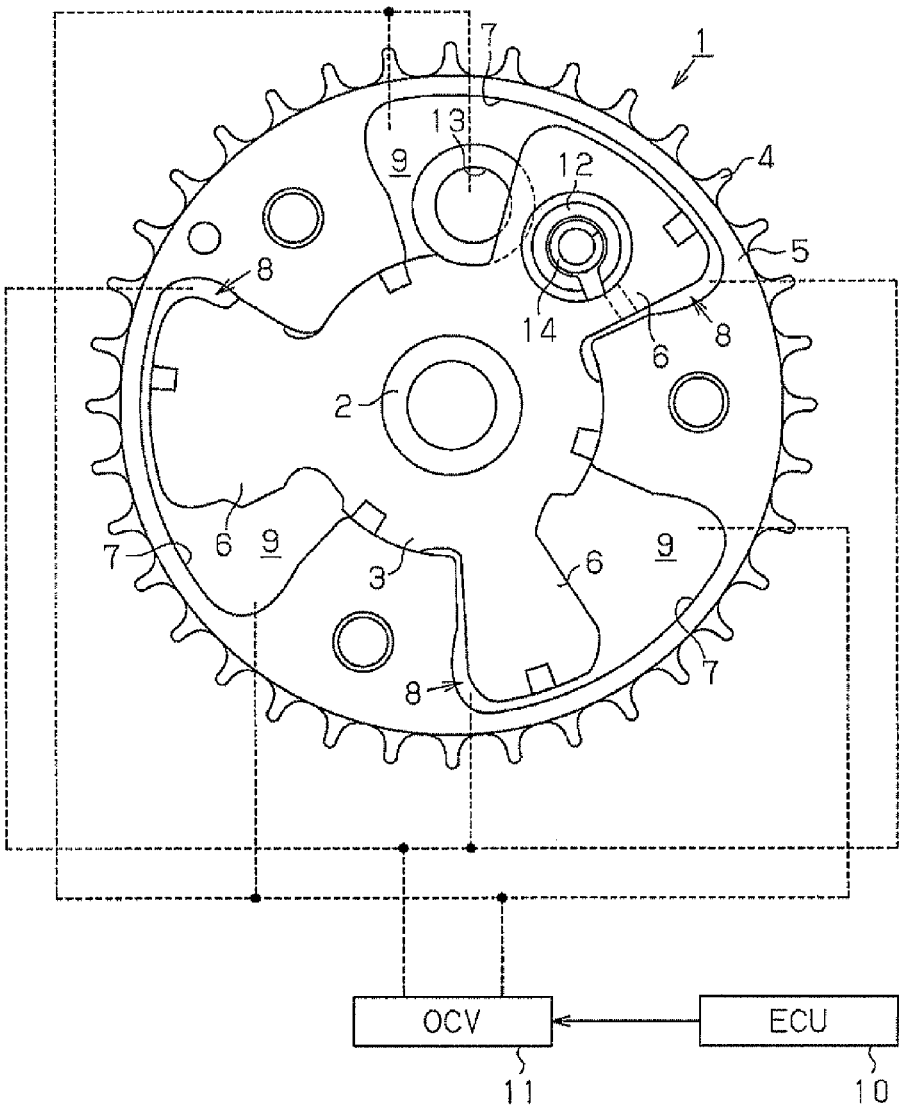
FIG. 6 is a cross-sectional view showing the front cross-sectional structure of the hydraulic variable valve timing mechanism.
Figure 7A:
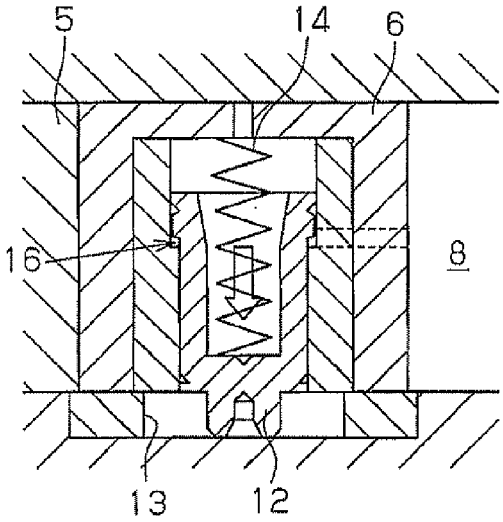
FIGS. 7(*a*) to 7(*c*) are diagrams showing changes in the state of a lock pin when a failure in release occurs.
Figure 7B:
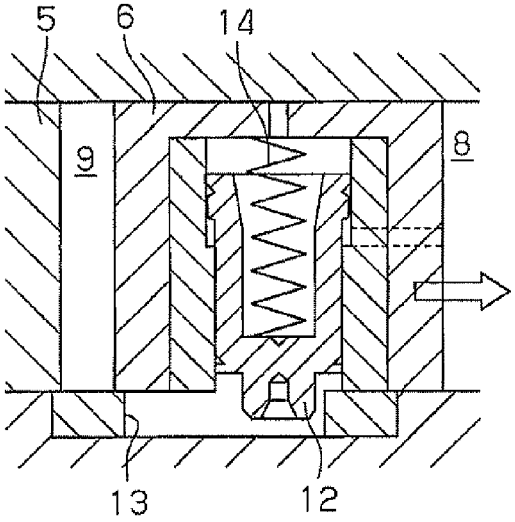
Figure 7C:
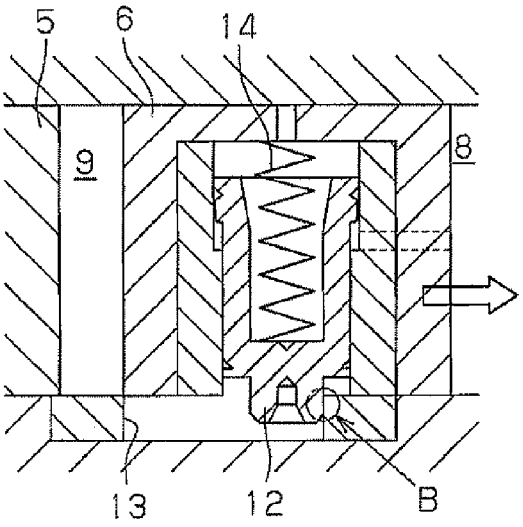

The control device of the present invention is also applicable to a hydraulic variable valve timing mechanism having a configuration different from that shown in FIG. 6 as long as the hydraulic variable valve timing mechanism has the following components (A) to (E):

(A) a first rotator fixed to a camshaft so as to rotate integrally with the camshaft;

(B) a second rotator that is rotatable relative to the first rotator;

(C) a retarding oil chamber in which hydraulic pressure is introduced to rotate the first rotator relative to the second rotator in such a direction as to retard valve timing;

(D) an advancing oil chamber in which hydraulic pressure is introduced to rotate the first rotator relative to the second rotator in such a direction as to advance the valve timing; and (E) a lock pin that mechanically locks the first and second rotators against relative rotation when engaged with the lock hole and allows relative rotation of the first and second rotators when released from the engagement with the lock hole in response to supply of hydraulic pressure.

DESCRIPTION OF THE REFERENCE NUMERALS

1 . . . Hydraulic variable valve timing mechanism, 2 . . . Camshaft, 3 . . . Vane rotor (first rotator), 4 . . . Cam sprocket, 5 . . . Housing (second rotator), 6 . . . Vane, 7 . . . Recessed portion, 8 . . . Retarding oil chamber, 9 . . . Advancing oil chamber, 10 . . . Electronic control unit (ECU), 11 . . . Oil control valve (OCV), 12 . . . Lock pin, 13 . . . Lock hole, 14 . . . Spring, 15 . . . Lock pin releasing oil chamber, 16 . . . Lock pin releasing oil chamber

The invention claimed is:

1. A control device for a hydraulic variable valve timing mechanism, the control device comprising:

a first rotator fixed to a camshaft so as to rotate integrally with the camshaft;

a second rotator that is rotatable relative to the first rotator;

a retarding oil chamber in which hydraulic pressure is introduced to rotate the first rotator relative to the second rotator in such a direction as to retard valve timing;

an advancing oil chamber in which hydraulic pressure is introduced to rotate the first rotator relative to the second rotator in such a direction as to advance valve timing;

an oil control valve that is configured to adjust hydraulic pressure in the retarding oil chamber and the advancing oil chamber;

a lock pin that mechanically locks the first and second rotators against relative rotation when engaged with a lock hole, and allows relative rotation of the first and second rotators when released from the engagement with the lock hole in response to supply of hydraulic pressure to one of the retarding oil chamber and the advancing oil chamber; and an electronic control unit having control logic configured to cause the electronic control unit to start release of the lock pin from the engagement with the lock hole at a time when cam torque in a direction opposite to the direction of relative rotation caused by supply of hydraulic pressure to said one of the oil chambers acts on the first rotator based on a crank angle, wherein valve timing of an engine valve is varied through relative rotation of the first and second rotators.

2. The control device for a hydraulic variable valve timing mechanism according to claim 1, wherein said one of the oil chambers is an oil chamber to which hydraulic pressure for changing valve timing is first supplied after the engine is started.

3. A control device for a hydraulic variable valve timing mechanism, the control device comprising:

a first rotator fixed to a camshaft so as to rotate integrally with the camshaft;

a second rotator that is rotatable relative to the first rotator;

a retarding oil chamber in which hydraulic pressure is introduced to rotate the first rotator relative to the second rotator in such a direction as to retard valve timing;

an advancing oil chamber in which hydraulic pressure is introduced to rotate the first rotator relative to the second rotator in such a direction as to advance valve timing;

an oil control valve that is configured to adjust hydraulic pressure in the retarding oil chamber and the advancing oil chamber;

a lock pin that mechanically locks the first and second rotators against relative rotation when engaged with a lock hole, and allows relative rotation of the first and second rotators when released from the engagement with the lock hole in response to supply of hydraulic pressure to one of the retarding oil chamber and the advancing oil chamber; and an electronic control unit having control logic configured to cause the electronic control unit to start release of the lock pin from the engagement with the lock hole at a time when cam torque in a direction opposite to the direction of relative rotation caused by supply of hydraulic pressure to said one of the oil chambers acts on the first rotator, wherein valve timing of an engine valve is varied through relative rotation of the first and second rotators.

4. The control device for a hydraulic variable valve timing mechanism according to claim 3, wherein said one of the oil chambers is an oil chamber to which hydraulic pressure for changing valve timing is first supplied after the engine is started.

5. A control device for a hydraulic variable valve timing mechanism, the control device comprising:

a first rotator fixed to a camshaft so as to rotate integrally with the camshaft;

a second rotator that is rotatable relative to the first rotator;

a retarding oil chamber in which hydraulic pressure is introduced to rotate the first rotator relative to the second rotator in such a direction as to retard valve timing;

an advancing oil chamber in which hydraulic pressure is introduced to rotate the first rotator relative to the second rotator in such a direction as to advance valve timing;

an oil control valve that is configured to adjust hydraulic pressure in the retarding oil chamber and the advancing oil chamber;

a lock pin that mechanically locks the first and second rotators against relative rotation when engaged with a lock hole, and allows relative rotation of the first and second rotators when released from the engagement with the lock hole in response to supply of hydraulic pressure to one of the retarding oil chamber and the advancing oil chamber; and an electronic control unit having control logic configured to cause the electronic control unit to start release of the lock pin from the engagement with the lock hole at a time when cam torque in a direction opposite to the direction of relative rotation caused by supply of hydraulic pressure to said one of the oil chambers acts on the first rotator when a crank angle is a specified angle, wherein valve timing of an engine valve is varied through relative rotation of the first and second rotators.

6. The control device for a hydraulic variable valve timing mechanism according to claim 5, wherein said one of the oil chambers is an oil chamber to which hydraulic pressure for changing valve timing is first supplied after the engine is started.

* * * * *